United States Patent [19]

Kuhlmann

[11] 4,215,713

[45] Aug. 5, 1980

[54] CONTROL VALVE FOR VISCOUS MATERIALS

[76] Inventor: Herbert Kuhlmann, Wibaustr. 1, 6466 Gründou-Rothenbergen, Fed. Rep. of Germany

[21] Appl. No.: 867,560

[22] Filed: Jan. 6, 1978

[30] Foreign Application Priority Data

Jan. 11, 1977 [DE] Fed. Rep. of Germany ..... 2700800

[51] Int. Cl.[2] ..... F04B 15/02; F16K 15/40

[52] U.S. Cl. ..... 137/238; 277/3; 277/15; 417/900

[58] Field of Search ..... 417/515, 518, 900; 277/3, 15; 137/237, 238, 240, 241, 312

[56] References Cited

U.S. PATENT DOCUMENTS

| | | | |
|---|---|---|---|
| 450,518 | 4/1891 | Mayer | 277/59 |
| 3,068,806 | 12/1962 | Sherrod | 417/900 X |
| 3,943,717 | 3/1976 | Schexnayder | 277/19 X |

FOREIGN PATENT DOCUMENTS

| | | |
|---|---|---|
| 6904407 | 2/1969 | Fed. Rep. of Germany . |
| 1678445 | 9/1969 | Fed. Rep. of Germany . |

*Primary Examiner*—Martin P. Schwadron
*Assistant Examiner*—Richard Gerard
*Attorney, Agent, or Firm*—W. G. Fasse; D. F. Gould

[57] ABSTRACT

The present control valve is intended to handle highly viscous material such as concrete mixes. For this purpose two valve plates are arranged in a valve housing in such a manner that in one position of the two valve plates relative to each other, one valve plate closes a suction inlet port and opens a pressure outlet port while the other valve plate opens a suction inlet port and closes a pressure outlet port. When the positions of the valve plates change, their respective operation is reversed. The valve plates are supported by drive rods which in turn are supported at both ends of the valve housing in respective slide bearings. One end of each drive rod is operatively connected to a hydraulic drive. The opposite end of each drive rod carries a piston movable in a cylinder, the far end of which is operatively connected to a rinsing liquid container. The rinsing liquid conduits extend through grooves in the slide bearings of each drive rod, whereby these rods are cleaned to protect the rod bearings.

4 Claims, 3 Drawing Figures

CONTROL VALVE FOR VISCOUS MATERIALS

BACKGROUND OF THE INVENTION

The invention relates to a control valve for viscous materials such as concrete mixes. The present valves are equally adapted for cooperation with single cylinder piston pumps as well as with double cylinder piston pumps for conveying concrete mixes. Such valves control the supply of concrete mix into a pump cylinder as well as the discharge of the concrete mix from the pump cylinder into a conveyor conduit connected to the pressure outlet port of the pump. Such valves may be equipped with valve plates which are shiftable back and forth by means of push rods in order to open or close a respective port when the plate or plates are in their end positions. Such valves are also equipped with the drive means for shifting the valve plates back and forth, including support means and rinsing or scavenging means as well as sealing means in a valve housing. The filling funnel is arranged above the suction channel.

Prior art modifications of the just described slide valves include tilting pipe slides, gate slides, roller slides, plate slides or combinations of the just mentioned systems.

German Utility Model No. 6,904,407 describes a plate slide or rather, plate slides for controlling the feed advance sequence in a so-called slush pump. Such pumps are capable of transporting highly viscous materials and the plate slides constitute the control slides as part of such a pump. The plate slides of the known control valve, according to said German Utility Model No. 6,904,407 are driven by hydraulic piston cylinder drives, whereby each plate slide controls either two suction ports or two pressure ports. The slide plate which controls the suction port is arranged horizontally below the filling funnel, whereby it closes the respective suction opening on the side of the pump on which the piston performs the pressure stroke. As a result of this arrangement a space is provided at the highest point in the pressure channel which space is not utilized because the medium to be conveyed does not flow through this space during the pressure stroke. Please also see in this context German Patent Publication (DAS) No. 1,678,445.

The material to be conveyed flows past and below this so-called dead space, whereby air accumulates in the dead space since such air is always contained in the concrete mix. The suction inlet opening is arranged adjacent to the plate slide and the latter does not close the suction inlet opening so that the material may flow from the filling funnel through said opening into the cylinder in which the piston of the pump performs the suction stroke. The piston on its suction stroke evacuates the pump cylinder as the piston moves back, whereby the concrete mix is filled into the evacuated cylinder under the influence of the atmospheric pressure to which the filling container is exposed. During this operation air flows from the dead space of the pressure side into the suction channel because the control slide or valve of these pumps is not airtight. Such airflow has the disadvantage that the suction cylinders are only incompletely filled with concrete mix.

In view of the above, prior art concrete pumps of the just described type have consistently a poor cylinder filling factor, especially where it is desired to transport the concrete mix with a large densification factor because the air bubbling out of the concrete mix on the pressure side is returned into the concrete mix on the suction side of the pump.

According to another prior art control valve for concrete mix pumps, a suction channel and a pressure channel are opened and closed in alternating succession by means of a plate slide. The plate slide of this prior art control valve is arranged between the two push rods extending in parallel to each other. The guiding of this type of push rods requires four bearings which depend on each other with regard to their adjustment. Arranging these bearings in exact axial alignment is rather difficult which means that this type of plate slide has a tendency for jamming, especially when the valve must operate under a relatively high pressure. Due to the just mentioned difficulties which have been encountered with flat, plate valve slides actuated by two push rods, concrete pumps are presently not equipped with such slide control valves.

The above mentioned control valves for concrete pumps are driven by hydraulic piston cylinder means, the housing of which is rigidly connected to a support structure and the piston rod of which is operatively connected to the push rod of the slide plate. The piston diameters of the hydraulic piston cylinder means is larger than the diameters of the push rods. Thus, a spacing is provided between the inner cylinder walls and the push rods and this spacing receives a rinsing or scavenging liquid which is taken out of a rinsing or scavenging liquid container by the suction movement of the piston and returned into the rinsing or scavenging liquid container with the pressure stroke of the piston. In operation of these prior art devices, the piston surface of the piston cylinder drive facing the push rod is subjected to a pressure medium. However, the sealing means provided between the concrete and the liquid cannot always completely prevent that components of the concrete mix such as fine sand and cement enter into the rinsing liquid.

Another problem with the described prior art devices is seen in that it is not possible to achieve an absolute sealing between the rinsing liquid and the pressure medium. In other words, the piston cannot be so completely sealed in the piston cylinder arrangement to achieve such a separation between the rinsing liquid and the pressure medium. Thus, components of the concrete mix not only enter into the rinsing liquid, but also into the pressure medium, whereby fine sand particles and cement enter into the hydraulic circuit which results in heavy damage to the hydraulic main pump which may even become completely unrepairable and thus useless. Thus, in order to prevent the entrance of solid particles from the concrete mix into the rinsing or scavenging liquid, it is necessary to frequently exchange the sealings of the control slides. Such exchanging becomes even more frequent as wear and tear progresses.

In the prior art devices the sealing means are located on the push rods behind or in front of the drive piston cylinder means. In addition, the sealing means are fixed in the housing of the control valve. Thus, in the prior art valves the sealings can only be exchanged by disassembling the piston cylinder drive means. This has the disadvantage that due to the substantial man hours required for the exchange of the sealings and the resulting costs, the sealings are rarely exchanged at the time when they should have been exchanged, namely, well before they reach a state in which they are completely useless. Neglecting the exchange of the sealing has happened, although the costs for removing the resulting damages, namely, replacing the entire pump, are generally substantially higher than the costs for the replacement of the sealings.

OBJECTS OF THE INVENTION

In view of the foregoing, it is the aim of the invention to achieve the following objects, singly or in combination:

to construct a control valve suitable to be an integral part of a single or double piston pump for conveying of concrete or other highly viscous materials which will permit an optimal filling degree for the suction cylinder;

to prevent in a slide valve the entrance of rinsing liquid into the pressure medium and to also prevent entrance of the pressure medium into the rinsing liquid;

to facilitate and simplify the exchange of the sealings as well as of the guide bushings which support the sealings without disassembling the drive means;

to avoid any connection between the suction channels so that an airflow from the pressure applying piston cylinder means to the suction applying piston cylinder means is avoided;

to support the slide plates with a minimum number of slide bearings while nevertheless preventing the jamming of the slide plates; and to substantially reduce the repairing and maintenance costs of slide control valves for viscous material pumps.

SUMMARY OF THE INVENTION

According to the invention each slide plate in a slide control valve is arranged in such a manner and connected to the respective push rod that it alternately closes or opens the suction channel or the pressure channel. One end of the push rod is connected to the respective drive means and the other opposite end of the push rod which also protrudes from the valve housing is provided with a piston which slides back and forth in a cylinder. The outward end of the cylinder is connected through rinsing liquid conduits to a rinsing liquid container, whereby the surface of the piston facing away from the valve housing is exposed to the rinsing or scavenging liquid. Preferably, the rinsing liquid conduits extend through channels or chambers in the guide bushings of the push rod at each end of the valve housing, whereby rinsing liquid is supplied through the system as a result of the suction and pressure movement of said piston in the cylinder so that the rinsing liquid flows out of the rinsing liquid container and back into the rinsing liquid container.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
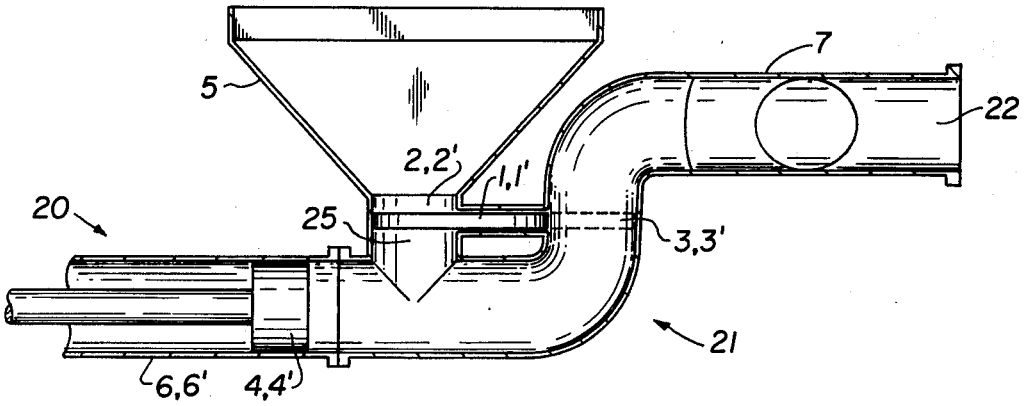
FIG. 1 shows a schematic illustration of a side view of a slide control valve according to the invention.
Figure 2:
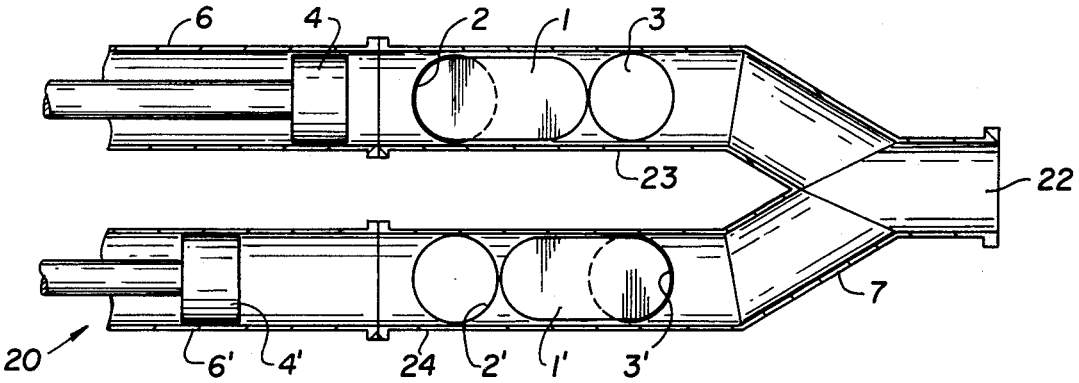
FIG. 2 illustrates a top plan view of the slide valve according to FIG. 1.

FIG. 1 shows a sectional side view of a double piston pump 20 connected through a slide valve 21 to a conveying pipe conduit 22 through a Y-connector pipe section 7. As best seen in FIG. 2 the double piston pump 20 comprises two pump cylinders 6 and 6' a material conveying piston 4 is movable back and forth in the pump cylinder 6. A material conveying piston 4' is movable back and forth in the pump cylinder 6'. The drive means for operating the pump pistons are conventional and hence not shown.

The slide valve 21 comprises two conveying channels 23 and 24. The conveying channels 23 and 24 are connected through respective suction channels 2, 2' to a supply hopper or funnel 5. Further, these conveying channels 23 and 24 are connected through respective pressure channels or ports 3, 3' to the Y-connector pipe section 7. Separate slide plates 1 and 1' are arranged to open and close the respective suction channel 2 and the respective pressure channel 3 as well as the respective suction channel 2' and the respective pressure channel 3'. The arrangement is such, that the slide plate 1 closes the suction channel 2 while simultaneously the pressure channel 3 is open. Similarly, in the shown position the slide plate 1' closes the pressure channel 3' while the suction channel 2' is open.

In operation, the piston 4 pushes or presses the concrete mix in the channel 23 through the port or channel 3 into the Y-connector 7 and thus into the conveying pipe 22. During this operation the suction port or channel 2 is closed as mentioned. At the same time, the piston 4' is performing its suction stroke thereby filling the conveying channel 24 with concrete mix from the hopper 5 while the port 3' is closed and the port 2' is opened. The operation and position of the slide plate is reversed when the piston 4' performs its pressure stroke and the piston 4 performs its suction stroke. For this purpose the slides 1 and 1' are shifted back and forth by separate drive means, the operation of which is responsive to the end positions of the respective positions 4 and 4' as will be described in more detail below with reference to FIG. 3. In any event, the control of the slides 1 and 1' is such that the slide plate 1 closes the pressure port 3 and opens the suction port 2 when the piston 4 reaches its end position. When the piston 4' reaches its end position, the slide plate 1' closes the suction channel 2' and opens the pressure channel 3' and vice versa.

The air entrained in the concrete mix collects in the space 25 adjacent to the suction ports 2 or 2' when, during the pressure stroke of the respective piston, the concrete mix is compressed. For this purpose, the invention provides the air collecting space 25 between the respective conveying channels 23, 24 and the suction ports 2, 2'. Since the slide plates 1, 1' do not close the suction ports 2, 2' in an airtight manner, the air collecting in the space 25 can escape into the hopper 5. Since according to the invention no connection is provided between the suction ports 2 and 2', air cannot flow from the cylinder under pressure to the cylinder under suction.

Figure 3:
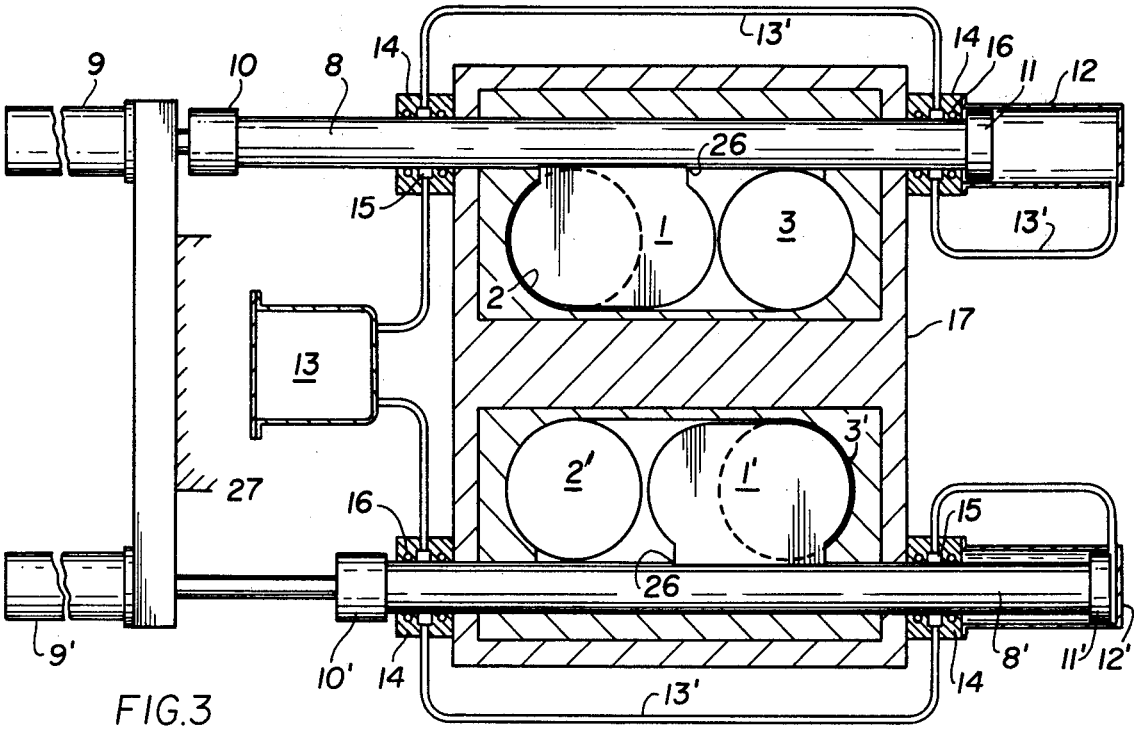
FIG. 3 illustrates a plan view partially in section of a slide valve according to the invention constructed for use in connection with a double piston pump, whereby the sectional plane extends substantially through the slide plates shown in FIG. 1, for simplicity's sake, the drive means and bearing means for the slide plates are not shown in FIG. 1.

Referring to FIG. 3 the slide plates 1, 1' are secured to respective drive or pushing rods 8 and 8'. For example, the slide plates may be welded along a longitudinal edge 26 to the respective rod. These rods are driven back and forth by piston cylinder drive means, 9 9' secured to a frame structure 27. To facilitate assembly, repair, and maintenance work, each rod 8, 8′ is connected to its respective drive means 9, 9′ through a coupling 10, 10′ of conventional construction.

It is a feature of the invention that the drive piston cylinder arrangement 9, 9′ of the rods 8, 8′ are completely separate from the rinsing liquid system comprising a container 13 holding the rinsing liquid and conduits 13′ for feeding the rinsing or scavenging liquid back and forth as will now be described.

Each slide moving rod 8, 8′ is supported at both ends in slide or guide bearing bushings 14 which may, for example, be secured to the valve housing 17 by means not shown in detail since they are conventional. Each bearing bushing 14 is provided with sealing gaskets 16 as well as with a rinsing liquid chamber or channel 15 as shown in FIG. 3. In the preferred embodiment the rinsing liquid container 13 is connected through respective pipes 13′ to the chambers 15 in the bearing bushings 14, whereby the respective chambers are connected in series. Further, according to the invention the end of each rod opposite the end connected to the drive means 9, 9′ is provided with a piston 11, 11′ which is slidable back and forth in a cylinder 12, 12′ which may be secured to the respective bushing 14 by means of a flange and screws not shown. The cylinder 12, 12′ may also be connected to the valve housing 17. In any event, each cylinder 12, 12′ is connected to its respective rinsing conduit or pipe 13′. The just described circuit for the rinsing liquid is thus completely separate from the hydraulic drive circuit so that no connection is possible between the pressure medium of the hydraulic drive circuit and the rinsing liquid of the rinsing system. When the pistons 11, 11′ move back and forth in the above described operation of the slides and drive rods 8, 8′, the rinsing liquid is either sucked or pressed out of the rinsing liquid container 13 or into the rinsing liquid container 13. In this manner any contamination or dirt that may be sticking to the drive rods 8, 8′ is washed off these rods by the rinsing liquid in the chambers 15. This feature of the invention greatly increases the operational life.

Due to the arrangement of the couplings 10, 10′ and the removability of the cylinders 12, 12′ it is easy to facilitate the maintenance and repair of the slide and guide bearings 14. Thus, it is easy to remove the rods and replace the sealings 16 without any difficulty.

Another important advantage of the invention is seen in the above mentioned removal of the air which is entrained in the concrete mix which removal is accomplished by the allocation, according to the invention, of the same slide plate to a suction port and to a pressure port, whereby the air which is collected during the pressure stroke in the space 25 may escape through the respective slide 1, 1′ which do not need to be airtight. Since the invention avoids any connection between the conveying channels, no air can travel from the cylinder under pressure to the cylinder under suction and vice versa. This feature in turn has the advantage that the formation of the vacuum in the cylinder under suction is not interfered with by the pressurized air cushion in the space 25 above the cylinder under pressure. This feature has the important advantage that the cylinder under suction is always filled to an optimal degree with the material to be conveyed.

Furthermore, the complete separation of the rinsing liquid circuit from the pressure medium in the hydraulic circuit of the drive cylinders of the push rods, 8, 8′ substantially reduces the wear and tear of the hydraulic drive system since the destructive influence of the rinsing liquid on the hydraulic drive system has been eliminated according to the invention.

Further, the couplings 10 and the removable feature of the cylinders 12, 12′ greatly facilitate the maintenance of the rods 8, 8′ and sealings 16. Besides, due to the improved filling ratio the efficiency and throughput capacity of the present valves has been greatly increased as compared to valves of the same kind and size of the prior art. This increased throughput capacity is due, as mentioned to the increased optimum filling degree and also due to the protection of the hydraulic drive system so that it cannot be endangered by the rinsing liquid. Further, the guiding of the rods at each end of the valve housing substantially eliminates any jamming of the slide plates 1, 1′ even if substantial counter pressures are involved. Thus, in summary the invention has substantially reduced the repair and maintenance costs of valves of this type.

Although the invention has been described with reference to specific example embodiments, it will be appreciated, that it is intended, to cover all modifications and equivalents within the scope of the appended claims.

What is claimed is:

1. A control valve for viscous materials comprising valve housing means, suction inlet port means in said valve housing means connectable to respective pump means, pressure outlet port means in said valve housing means connectable to conveying conduit means for said viscous materials, valve plate means arranged for sliding movement in said valve housing means to open and close said inlet port means and said outlet port means, drive rod means operatively connected to said valve plate means, guide bearing support means operatively supporting said drive rod means at opposite ends of said valve housing means for sliding back and forth movement of said drive rod means, drive means (9, 9′) operatively connected to one end of said drive rod means (8, 8′) for reciprocating said drive rod means, piston means (11, 11′) at the opposite end of said drive rod means, cylinder means (12, 12′) arranged so that said piston means (11, 11′) are movable in said cylinder means, and rinsing liquid supply means (13, 13′) operatively connected to said cylinder means (12) so that said piston means (11, 11′) on its pressure stroke moves against the rinsing liquid in said cylinder means, said bearing support means (14) comprise chamber means (15) surrounding said drive rod means, said rinsing liquid supply means comprising a rinsing liquid container (13) and rinsing liquid conduit means (13′) operatively interconnecting said rinsing liquid container (13) and said cylinder means (12, 12′) through said chamber means (15) in said bearing support means (14), whereby said drive rod means are directly cleaned in said chamber means of said bearing support means.

2. The control valve of claim 1, further comprising coupling means operatively arranged between said drive means and said drive rod means.

3. The control valve means of claim 1, wherein said guide bearing support means comprise sleeve bearing means and liquid sealing means in said sleeve bearing means.

4. The control valve means of claim 1, wherein said inlet port means comprise first and second inlet ports, wherein said outlet port means comprise first and second outlet ports, said valve plate means comprising a first valve plate and a second valve plate arranged in such a manner that the first valve plate cooperates with the first inlet port and with the first outlet port, whereas the second valve plate cooperates with the second inlet port and with the second outlet port, whereby the first inlet port is closed when the first outlet port is open, and whereby the second inlet port is open while the second outlet port is closed.

* * * * *